US009521911B2

(12) United States Patent
Hebenthal

(10) Patent No.: US 9,521,911 B2
(45) Date of Patent: Dec. 20, 2016

(54) FURNITURE SYSTEM FOR ADJUSTING SOUND LEVELS IN CHILDREN'S ROOMS

(71) Applicant: Nancy Hebenthal, Redmond, WA (US)

(72) Inventor: Nancy Hebenthal, Redmond, WA (US)

( * ) Notice: Subject to any disclaimer, the term of this patent is extended or adjusted under 35 U.S.C. 154(b) by 0 days.

(21) Appl. No.: 14/246,091

(22) Filed: Apr. 5, 2014

(65) Prior Publication Data

US 2014/0299410 A1 Oct. 9, 2014

Related U.S. Application Data

(63) Continuation-in-part of application No. 13/833,926, filed on Mar. 15, 2013, now abandoned.

(51) Int. Cl.

| | |
|---|---|
| ***A47B 83/00*** | (2006.01) |
| ***A47D 1/00*** | (2006.01) |
| ***A47D 11/00*** | (2006.01) |
| ***G10K 11/16*** | (2006.01) |

(52) U.S. Cl.

CPC ..... *A47D 1/00* (2013.01); *A47B 83/00* (2013.01); *A47D 11/00* (2013.01); *G10K 11/16* (2013.01); *A47B 2220/13* (2013.01)

(58) Field of Classification Search

CPC ..... A63H 33/008; A63H 33/10; A63H 33/04; A63H 33/06; A47B 83/00; A47D 1/00; A47D 11/00; A47D 13/00; A63B 9/00; A63B 2009/006

USPC ..... 181/175; 297/118

See application file for complete search history.

(56) References Cited

U.S. PATENT DOCUMENTS

| | | | | |
|---|---|---|---|---|
| 3,572,698 | A * | 3/1971 | Greenly | A63B 9/00 482/36 |
| 3,600,844 | A * | 8/1971 | Simpson | A63H 33/04 446/118 |
| 3,925,941 | A * | 12/1975 | Pearce | A63B 9/00 52/80.2 |
| 5,655,558 | A * | 8/1997 | Child | E04H 15/48 135/100 |
| 6,210,247 | B1 * | 4/2001 | Rodriguez Ferre | A63B 9/00 446/476 |
| 7,104,864 | B1 * | 9/2006 | Liou | A63H 33/10 446/221 |
| 7,445,285 | B2 * | 11/2008 | Cohen | A47D 1/00 297/181 |
| 7,690,158 | B2 * | 4/2010 | Kelly | E04B 2/7429 181/291 |
| 2012/0184177 | A1 * | 7/2012 | Ochi | A63B 17/00 446/227 |
| 2012/0213961 | A1 * | 8/2012 | Graham | A47B 47/0075 428/43 |

FOREIGN PATENT DOCUMENTS

| | | | | |
|---|---|---|---|---|
| NL | WO 2007091885 | A1 * | 8/2007 | A63H 33/048 |

* cited by examiner

*Primary Examiner* — Jeremy Luks

(74) *Attorney, Agent, or Firm* — Patrick M Dwyer

(57) ABSTRACT

A furniture system for optimizing sound levels and acoustics in a learning environment. The system includes a plurality of pieces selected from a toy shelf, a bridge/tunnel structure, a sandwich board shelf unit, a tunnel with interior shelves, a toy box with leaning bendable posts, a bench/tunnel with combination seat, tunnel, and shelf, a listening center, a stealth chair/cave structure, stealth leaning surface/cave, a multifunctional zigzag chair, and a multipurpose chair/easel.

7 Claims, 8 Drawing Sheets

FURNITURE SYSTEM FOR ADJUSTING SOUND LEVELS IN CHILDREN'S ROOMS

CROSS REFERENCE TO RELATED APPLICATIONS

This application claims priority to U.S. patent application Ser. No. 13/833,926 filed Mar. 15, 2013 which claimed priority to U.S. Provisional Patent application 61/612,361 filed Mar. 3, 2012, both of which are hereby incorporated by this reference as if fully set forth herein.

TECHNICAL FIELD

The disclosure relates to children's play furniture for optimizing sound levels and acoustics in a learning environment, and to a system for influencing the acoustics and adjusting sound levels in a room, and to a method for optimizing sound levels and acoustics in a learning environment.

BACKGROUND

Today many children spend more of their awake time in a day care facility or other learning environment than at home. Day care rooms can be very loud. Excessive noise can adversely affect a child's hearing, language development, ability to learn, social interactions and overall well-being. There are appropriate times for high noise volume, and times when lower volume is necessary throughout a child's day. Most day care center design does not take any of this into consideration. Few states have laws or guidelines regarding such considerations, and those that do are very vague.

The intensity of sound is measured in decibels (dB). The higher the decibel, the louder the sound, or amplitude. Decibels can be manipulated by use of reflective or sound absorbent material, the shape, and form of these materials and/or building structures. For every increase of 10 decibels, sound intensity increases tenfold. For example, 20 dB is ten times as loud as 10 dB, and 30 dB is ten times louder than 20 dB. To give a basic idea of sound levels on a decibel scale, zero is the least perceptible sound. Human breathing is at about 10 dB and speech is between 50 and 70 dB. Decibels between 60 and 80 are considered to be loud, and long term exposure to 80 dB and above can cause hearing loss. Sound at about 130 dB can cause pain. To see average decibel levels for other common sounds, refer to Egan, David M., *Architectural Acoustics*, McGraw-Hill Book Company, 1988.

Perception to sound and sensitivity to sound and noise is unique to each individual. It is dependent on hearing ability, frequency, "time of occurrence, duration of sound, and psychological factors such as emotions and expectations" (Architectural Acoustics, 1988). Noise is unwanted sound. Any noise that is abrupt, intermittent, or fluctuates widely can be extremely annoying. Human hearing is generally less sensitive to low frequency sound. Changes in decibel levels at about 6 dB and above are clearly noticeable. It is hard for humans to disregard sound that contains speech or music.

The US Department of Labor established the Occupational Safety and Health Administration (OSHA) in 1970. OSHA's mission is "to ensure safe and healthful working conditions for working men and women by setting and enforcing standards" (http://osha.gov/about.html). OSHA enforces regulations to protect against hearing loss caused by exposure to noise in the workplace. They have established how long a person can be exposed to particular decibels in a given day. The decibels are "A" weighted, which means they are measured by an instrument that measures sound levels at the frequency of human ears, and are noted as dBA. Since then, other health organizations have adopted similar charts.

White noise, noise that is produced by combining sounds of all different frequencies together, is often used to mask other sounds because your brain cannot pick out just one sound to hear or listen too. It is often used in offices and other situations where privacy is an issue. However, white noise can sometimes be annoying to those that are sensitive to sound.

When sound strikes the surfaces of a room, part of the energy is absorbed, and part of it is reflected back into the room. Depending on the structures intended use, the amount of sound absorbed or reflected can influence the experience. The amount of sound a material absorbs is referred to as a absorption coefficient. A zero coefficient means that no sound is absorbed. Materials that absorb all of the sound have the highest rating, a coefficient of one.

You can reduce the decibels by using sound absorbing materials. These materials are porous, trapping the sound waves in tiny air-filled spaces where they bounce around until their energy dies. Examples of sound absorbing materials are drapery, clothing, fibrous ceiling tiles, and carpet.

The effectiveness of the material used for absorption is based on the physical thickness, density, porosity, fiber diameter, and orientation. The internal structure must have interconnected pores to be highly effective. An easy way to test if a material can be an effective sound absorber is to blow through it. If the material is thick and air passes with moderate pressure, it should be a good absorber.

In addition to wall, ceiling, and floor treatments, you can manipulate sound by adding baffles and clouds to the room. Both are very effective sound absorbers that work well to reduce reverberation and increase speech intelligibility. Baffles are vertical panels in which all edges and sides are exposed, placed in specific areas of the room. They work best when spaced apart. Clouds are horizontal baffles, which work in the same way. Both can be fixed in place, or movable to accommodate different functions in multi-purpose spaces.

Hard, dense surfaces such as wood, tile, and concrete, reflect more sound than they absorb. There are times when this is favorable, such as sporting events when you want the crowd to be excited, or in a concert hall, where you want the sound to reverberate in a controlled manner.

The shape of a room, baffles, diffusors, etc., along with the angle of its form, affect the way sound travels throughout a space. Sound reflects, distributes, and reverberates off different shapes and angles in different ways, and will effect the way in which the sound is distributed and received by the listener. A domed ceiling, for example, can create a whispering gallery effect. This is when a person at one corner can whisper, and the person in the opposite corner will hear clearly, while a person standing only a few feet away from the speaker cannot hear. The shape allows the sound energy to reflect along the domed ceiling surface. The whispering effect can be avoided by using a sound absorption liner. Baffles or clouds can be used to either absorb or redirect the sound, depending on the material they are composed of, and the angle in which they are hung.

The intended purpose of the room will dictate how the room is shaped, and the forms within it. For example, in an auditorium, a flat ceiling reflects sound from the stage in the front to the back with only one useful reflection.

By contrast, a sloped ceiling increases the amount of sound reflection so that the middle and rear seats receive reflections from both the ceiling planes, improving audibility throughout the auditorium.

Infants and children hear differently than adults. Children's hearing is very sensitive. Even though their inner ear is fully developed at birth, their ear canal is still very small. In turn, the sound entering into the canal has less room to develop, causing it to become much louder. Sound can be as much as 20 dB louder for infants than for adults, creating a greater chance for damage from loud noises. Auditory development continues into adolescence, progressing through three stages. The first stage happens from birth through 6 months, the second from 6 months to 5 years, and the third stage from 5 years through adolescence. During these stages it is more difficult for children than adults to hear the details of speech, to learn, and to comprehend in noisy conditions. The need for proper acoustic environments for infants and children in which to learn is emphatic.

Stage one, maturing of sound coding, happens from birth through 6 months. During this time, the middle ear is less efficient than an adult's ear in transmitting sound to the inner ear. The transmission of sound through the inner ear to the brainstem is still developing. Ability to differentiate frequencies is immature, especially high frequencies. Sound transmission through the middle ear improves greatly during the first year, then continues at a slower pace through adolescence.

Stage two, selective listening and discovering new details in sound matures between the ages of 6 months to 5 years. At six months the middle ear is much more efficient and the brain stem transmission has matured. During the age bracket of 6 months to 5 years, infants and children listen to all frequencies, while adults listen to the most useful. This makes it difficult for them to distinguish between target sounds and background noise, which in turn makes it hard for them to hear a target sound.

> This finding implies that learning about sound will be more difficult for infants and preschool children in noisy environments and those in which there are several competing sources of sound . . . . The development of selective listening involves not only picking out one sound among several, but also listening to the details in complex sounds such as speech. (Lynne Werner, 2007)

Stage Three, the maturing of perceptual flexibility takes place from 6 years through adolescents. By age 6, children are able to focus on useful parts of sound, and are not as influenced by background noise. However, the presence of noise or reverberation can make it difficult for a child to hear specific aspects of speech, even if an adult is able to hear well. For children to hear in noisy situations, more attention and processing is required, and many children cannot manage this, since the ability to process in high levels of background noise is not yet fully developed.

Affects of Noise on Children

The study of psychology and acoustics combined is called psychoacoustics, which studies the response of humans to sound. They define noise as "unwanted sound". (Noise and Hearing Loss, OSHA, 1997-2010) What exactly makes a sound noise is different for each individual. Noise that is pleasant to some, is annoying to others.

There are times when noise is appropriate, and can stimulate wanted behavior, such as at sporting events, during exercise, and at times when enthusiastic participation is desired. However, noise can also stimulate unwanted behavior, affect physical and emotional health, and affect the way in which a child learns and develops. Noise also makes verbal communication harder, and sometimes impossible.

Physical and Emotional Affects of Noise

The most noticeable physical affect of noise is on hearing ability. It can be a temporary problem, such as at a concert, or permanent. Damage to hearing occurs in two ways. Brief exposure to an extremely loud sound like a firecracker may cause instant damage. The second is by consistent exposure to moderately loud levels of sound, (over 80 dB), that over time wear out the tiny hair cells in the inner ear. These hair cells are the nerve receptors for hearing. Signals from them are translated into nerve impulses that are sent to the brain. They do not have the ability to repair themselves, so damaging them causes permanent loss of hearing.

> The number of Americans age 3 and older with some form of hearing disorder has more than doubled since 1971 (according to the National Institute on Deafness and Other Communication Disorders). US government survey data revealed that 12.5% of children ages 6 to 19 (approximately 5.2 million children) have permanent damage to their ears' hair cells caused by exposure to loud noises. (www childrenshearing.org)

Noise can also cause an upset stomach, increase breathing rate, increases blood pressure, and make it difficult to sleep, even after the noise stops. When verbal communication competes with noise, it can strain the vocal cords.

Emotionally, noise can cause fatigue, irritability, stress, and nervousness. All of these can have an adverse affect on our ability to perform tasks and to pay attention. They may adversely affect our behavior towards ourselves or others. Excessive noise can cause a child to become withdrawn, feel overwhelmed, or over stimulated. It can cause a child to feel insecure or scared.

Noise Affects a Child's Learning and Development

Noise affects the way a child hears sounds, and speech. When their environment is loud, they have a difficult time hearing and/or distinguishing sounds and words that are new to them, or that they are unfamiliar with. This adversely affects their communication skills, and reading skills, as well as their cognitive skills.

Noise may also affect a child's ability to focus on the task at hand. Even when they appear to be playing or working on a particular task, background noise can affect how much they are really understanding in relationship to what they are doing, and cause their thoughts to wonder. It can also affect their ability to make choices, cause confusion, and misunderstanding, as well as affect a child's social interaction.

Recommended dBA Levels for Schools

Although current research shows that noise levels in schools are a detriment to children's learning and overall well being, there are no US government regulations in place regarding this issue. However, in 1998 the US Access Board joined with the ASA to develop an acoustic classroom standard. The work has been accredited by the ANSI, and is known as the "ANSI/ASA SR.60-2010 American National Standard Acoustical Performance Criteria, Design Requirements, and Guidelines for Schools, Parts 1 and 2" sets specific criteria for maximum background noise at 35 dBA and a reverberation time for unoccupied classrooms at 0.6-0.7 seconds. It is voluntary unless referenced by a state code. (http://www.access-board.gov/acoustic/index.htrn)

A majority of states do not have a noise standard for day care and early childhood learning centers.

The quality of a room is dependent at least in part on its acoustic properties. The acoustics of a room are a function of the geometry of the room and its floor, wall and ceiling materials. But just as important are the furnishings of the room and its occupants. Furnishings influence the acoustics of rooms and may be optimized to achieve desired acoustic characteristics in a room. The furnishing elements can take care of absorbing sound and or deflecting it. It is known to use flat absorber elements in the style of panels which are fitted in the wall and/or ceiling area to absorb sound and reduce reverberation time overall. Freestanding acoustic room dividers are also known to have a sound-directing effect. Known wall and ceiling panels are not readily integrated into a room because large wall areas can be covered by furniture immediately in front of them, because large window areas can be present and because such panels are integrated into a room's interior architecture or into the lighting design only with difficulty. Known room dividers (partition walls) require additional space and thus reduce usable room area, and they cannot be positioned in their acoustically optimum arrangement but are subject to the functional needs of the room.

Furniture is generally used to divide rooms into learning centers. The children play between them, where the noise may be trapped. But decibel readings at a child's level were as much as 5 Db. louder than readings above the furniture, at adult standing level.

Decibel Readings in Child Day Care Centers

Decibel readings were taken in 4 child day care centers. General noise in the rooms includes noise coming from other rooms, outdoor noise, HVAC systems, talking, crying, people moving about the room and centers. During group time the average readings were between 62 and 80 decibels (this includes story time and lessons). During free play time, readings ranged between 78 and 106 decibels, depending on what the children were doing. (This sound includes voices, blocks being built with and knocked down, various other toys, dress up and house play, art, and the like.) Overall day care averages were between 83 and 95 decibels. OSHA requires hearing protection be used at decibels of 85 and above in the work place, and that all employees attend hearing loss prevention work shops. If child day care centers were under the guidelines of OSHA, all of the staff and children in these facilities would be required by law to wear hearing protection!

DISCLOSURE

A furniture system is disclosed for optimizing sound levels and acoustics in a learning environment. The system has any of a plurality of furniture pieces selected from a toy shelf, a bridge/tunnel structure, a sandwich board shelf unit, a tunnel with interior shelves, a toy box with leaning bendable posts, a bench/tunnel with combination seat, tunnel, and shelf, a listening center, a stealth chair/cave structure, stealth leaning surface/cave, a multifunctional zigzag chair, and a multipurpose chair/easel.

The plurality of selected pieces includes multiple instances of a particular piece, and a plurality of the selected plurality have at least a partial outer layer of acoustical material.

In one embodiment of the disclosed system, at least one of the selected pieces is a toy shelf that is a shelf unit with a plurality of horizontal shelves, a generally flat shelf backing and a plurality of bins having front and back sides. The shelfbacking and the bin back sides are angled forward at an acute angle to the shelves and the bins are slidably engage able upon the shelves in a conventional manner. The shelf backing and the bin front and back sides desirably have a plurality of perforations.

The furniture system has at least two shelf unit sides and the sides have curved side tops. The sides are Desirably covered in acoustic fabric. The acute angles of the shelf backing and the bin back sides are desirably generally the same angle, but do not have to be.

In one embodiment of the disclosed system, at least one of the selected pieces is a bridge/tunnel structure that is a multi-use play structure with an arch piece that has an inside and an outside. The arch piece desirably has acoustic fabric covered padding or insulation on both the inside and the outside, but may also have such padding on only one side.

The arch piece may an optional floor piece.

In one embodiment of the disclosed system, at least one of the selected pieces is a sandwich board shelf unit that is a shelf unit made of two shelf backing pieces joined at an angle along a top portion of each piece. A plurality of shelves are attached to each backing piece, and the backing pieces are desirably covered at least partially by acoustic fabric.

One or both of the two shelf backing pieces desirably have fanciful and or non-rectangular shapes to increase play appreciation, and aid in sound disruption with their irregular shapes.

In one embodiment of the disclosed system, at least one of the selected pieces is a tunnel with interior shelves that is a multi-use play structure with two generally vertically arranged end pieces with a tunnel opening in a lower portion of each end piece. The end pieces are structured so they are joined and supported with at least one generally horizontal member between them. At least one shelf is situated between the two end pieces and an acoustical covering material is engaged along at least a portion of the respective edges of both end pieces to at least partially enclose the play structure.

Both end pieces desirably have acoustical covering on at least a portion of both ends, inside or outside or both, and the profiles of the end pieces desirably contain curves to aid in sound disruption with their irregular shapes.

In some embodiments, at least one shelf is structured as a low bench for children to sit on. In other embodiments, there are a plurality of shelves separate from such a bench, and generally arranged on a side of the tunnel opposite the bench.

The acoustical covering over the tunnel structure is desirably open along, and does not cover, at least a portion of the top of the play structure to facilitate adult supervision of activity inside the structure.

In one embodiment of the disclosed system, at least one of the selected pieces is a toy box with leaning bendable posts that is a multi-use play structure with a container and a plurality of leaning posts all attached to a base. Desirably at least one post is padded with sound absorbing material. Alternate embodiments may have only the leaning posts, or only the toy box.

Where the container is part of the furniture piece, a liftable or removable lid is padded on an underside, and where posts are included, at least one of the posts is oval in cross-section.

There is desirably a user bendable region in an upper portion of at least one post.

The container can be generally round in shape.

In one embodiment of the disclosed system, at least one of the selected pieces is a bench/tunnel that is a multi-use play structure with a generally arch shaped and irregularly surfaced (non-smooth) main member that serves as a play cave and or tunnel. On one side of the main member is a generally flat bench-like or table-like surface for use generally as a table or bench, and on another side of the main member is a smaller arch (tunnel) shape. The main member has two openings along a middle axis between the openings.

There is advantageously at least a partial acoustical covering material overlaid upon the play structure and optionally also inside and under the play structure covering.

The smaller arch shape is generally tunnel-shaped and generally perpendicular to the axis between the two openings in the main member.

In one embodiment of the disclosed system, at least one of the selected pieces a listening center that is a multi-use play structure has four sides in a generally rhomboid shape, the four sides connected respectively at an upper edge, a lower edge and two middle edges. The four sided structure formed thereby has a lower portion the bottom of which is the lower edge. There is a generally horizontal shelf across two sides in the lower portion and at least one and preferably two legs or panels depending from each of the middle edges down to the floor or optional base.

The play structure optionally has a base, and the base interengaged with the lower edge of the rhomboid and with at least one leg from each of the middle edges.

The rhomboid shape is advantageously a diamond shape, and has an optional speaker located in an upper portion of the play structure.

The play structure optionally has an outer shell of acoustical material.

In one embodiment of the disclosed system, at least one of the selected pieces is a stealth chair/cave structure that is a generally three-sided open multi-use play structure with two side panels and a rear panel. The two side panels are connected along their respective upper edges. A rear face of the rear panel is disposed at an obtuse angle to the horizontal so a child can lean back against it.

The play structure has at least a partial outer shell of acoustical material.

The rear panel has three edges and is connected along respective upper edges to respective rear edges of the two side panels.

The play structure also optionally has each of the two sides further comprising respective dihedral panels.

The two sides of the play structure are desirably non-rectangular in shape.

The non-rectangular sides desirably have curved front edges, and the play structure thereby has a front-facing projection or beak at the front of the upper edges of the two side panels.

The play structure also optionally has a base.

In one embodiment of the disclosed system, at least one of the selected pieces is a convertible and multifunctional zigzag chair that is a multi-use play structure with at least three panels connected at dihedral angles A and B on either side of a middle panel. Angle A is generally a right angle to the middle panel and angle B is desirably an angle obtuse to the middle panel and is on a face of the middle panel opposite to the face containing angle A. The play structure has at least a partial layer of padded acoustical material.

All three panels are desirably rectangles, though other shapes such as triangles may be substituted for the end rectangle pieces without departing from the scope of the claims. A hard surface is desirable on a face of the play structure opposite to the play structure face on which the acoustical material is disposed.

A method for optimizing sound levels and acoustics in a physical learning environment is also disclosed. The method includes the step of placing into the physical environment a plurality of furniture pieces or play structures detailed above and elsewhere in this disclosure.

The plurality of selected pieces may always include multiple instances of a particular piece, and a plurality of the selected plurality have at least a partial outer layer of acoustical material.

DETAILED DESCRIPTION

Figure 1A:
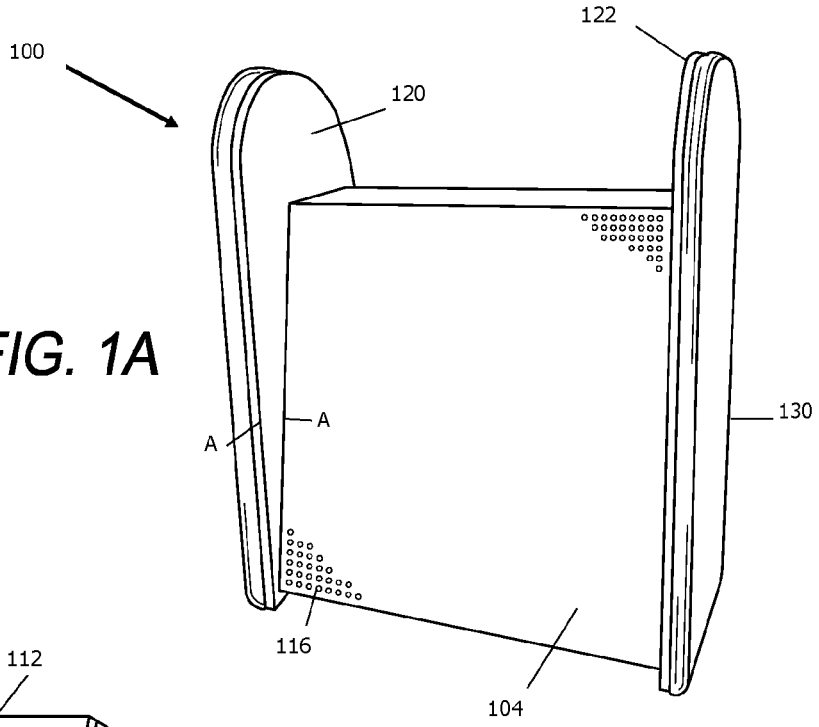
FIGS. 1A,B,C is a perspective schematic illustration of an aspect of the disclosed furniture system.
Figure 1B:
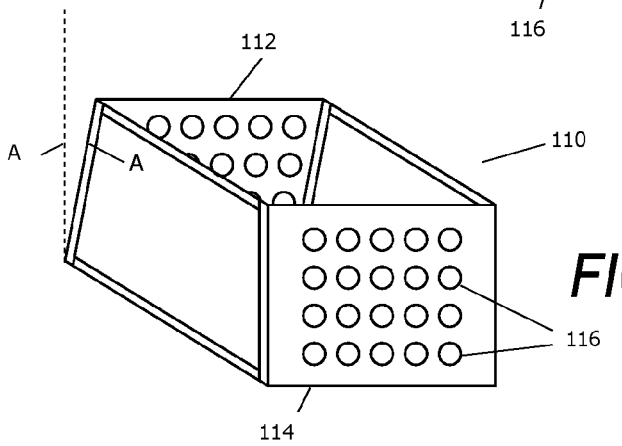
Figure 1C:
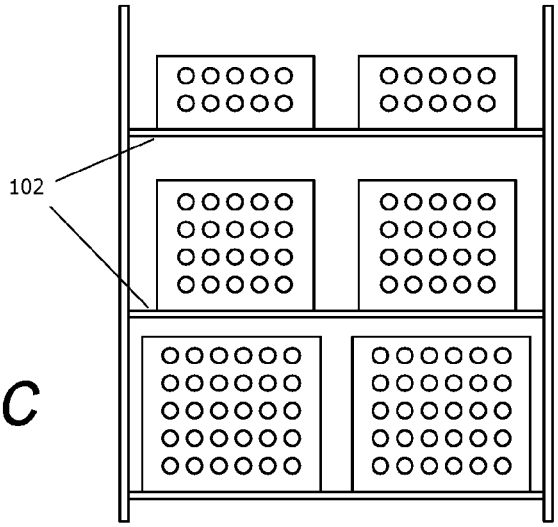

Studies of Noise in Day Care Centers

Three day care centers were studied for an average of 2½ hours at each center, with decibel readings taken and activities noted. The age of the children were older 3 year olds and 4 year olds, together in one class room. Each class had two instructors. In Center 1 there were 19 children in a mostly closed room, with doors open to stairs going to an upper and lower floor, and adjacent to a toddler room with open doors. In Center 2 there were 11 children in a mostly closed room, with doors open to the hall, 8 foot walls open above and a ceiling height of about 12 feet. In Center 3 there were 18 children in a totally enclosed room, with 3 small decorative fabric items hanging from the ceiling, and some other craft-type items hanging (a paper mache solar system).

At centers 1 and 3, there were 19 and 18 children in the room. At center 2, there were 11. This made a significant difference in the decibel readings. Center 2 with the fewer children had readings from 66 dBA to 86 dBA, with an average decibel reading of 78 dBA. Center 1 with 19 children had decibel readings between 70 dBA and 106 dBA, with an average of 86. Center 3 with 18 children had decibel readings between 60 and 102, with an average of 82. The rooms were quietest during story time with readings of around 60 and 76, varying on the voice of the reader, and the children's interaction. They were the noisiest at free time, with a play area being the loudest at 106 dBA at both centers 1 and 3.

Center 1 had tall bookshelves dividing the play centers, a few very thin rugs on the floor, curtains on 2 windows that were rolled up. The noise between in the play areas enclosed by the book shelves were about 6 to 10 dBA louder than the areas that were open, such as at the tables were children were coloring or doing art projects.

Center 2 had medium height or lower book shelves creating areas, but less of them. They were mostly lining the walls. Center 3 also had medium height to lower book shelves creating area. The room was about the same area as at center 1, but the floor plan was different, with larger play areas.

It appears that the higher book shelves had a higher decibel reading than the areas with the lower shelves, because some of the sound was allowed to escape over them, rather than being trapped by the taller shelves. The area in center 3 that had shelving with a perforated back had slightly lower decibel readings, around 4 dBA lower, than the areas with same height shelf, but with a solid, white board/magnetic backing.

The behavior of the children in center 1 was more aggressive than the other two centers, with children knocking down other's blocks, arguing over magnets and other toys, occasional children yelling, and very loud voices at all of the centers. The number of children was limited in each area, but in both the block and magnet area, children were arguing over who got to stay there and play. The teachers kept there voices calm while working with the children, although seemed to be a bit agitated by the end of the morning. The general atmosphere of the room was cluttered and the play areas felt enclosed. You could constantly hear a drone-like sound of toddler activity in the adjacent rooms. There was also low, but nearly constant sound of foot steps from the floor above, at times loud stomping.

The behavior of the children in centers 2 and 3 was much more easygoing. There was very little arguing between the children, they seemed calm for the most part, except the occasional excitement of accomplishing a floor puzzle or knocking down of a block building. The atmosphere at both of these rooms was more open, and less cluttered, with ample room for the children at all of the centers, except the block area. The teachers in these two centers remained calm and showed no signs of fatigue or agitation by the end of the morning.

Turning now to the drawings, the disclosed devices are described by reference to the numerals of the drawing figures wherein like numbers indicate like parts.

FIGS. 1A,B,C shows a toy shelf. The flat, angled back of peg board backing allows some incident sound to deflect at an upward angle, with other sound passes through and dissipates among the bins on the shelves. The back can be constructed of various materials. Sides are fabric covered Micor® or the like for sound absorption, and also double as bulletin boards. Curved side tops are believed to disperse sound. Angle back bins with perforated fronts and backs are made to fit the toy shelf. The angled back bins make the best use of space on the angled back toy shelf. The perforations in the bins are believed to allow noise in the area to flow through the bins. Some noise is trapped inside, bouncing around and dissipating within the contents of the bin. Some noise flows through and out the back of the bin. The bins can be manufactured using wood, various colors of recycled plastic or acrylic. Sizes will vary depending on the shelving unit ordered.

Shelf unit 100 has a plurality of horizontal shelves 102, a generally flat shelf backing 104 and a plurality of bins 110, each with front side 114 and back side 112. Shelf backing 104 and the bin back side 112 are angled forward at an angle A that is acute to the shelves. The acute angles of the shelf backing and the bin back sides are advantageously the same angle, but small variations in angles can be made to serve as well. The bins are slidably engageable upon the shelves, and the shelfbacking and the bin front and back sides advantageously have a plurality of perforations 116. The shelf unit has at least two shelf unit sides 120, the sides desirably have curved side tops 122. The sides are advantageously covered at least partially in acoustic fabric 130, or a combination of sound absorbing material and acoustic fabric.

Figure 2:
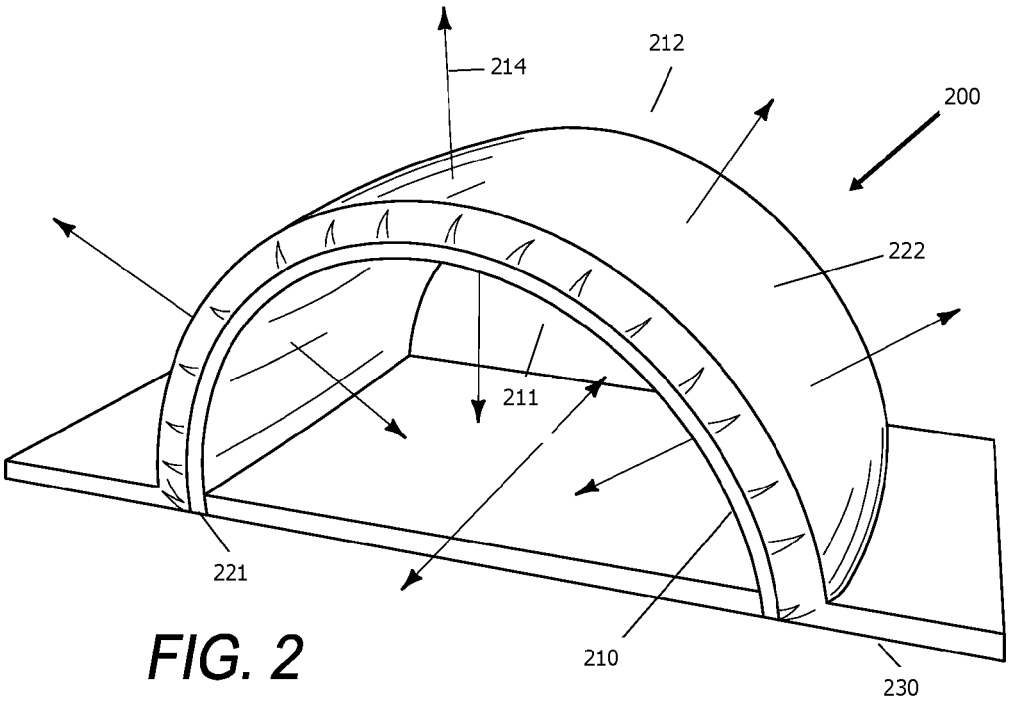
FIG. 2 is a perspective illustration of an aspect of the disclosed furniture system.

FIG. 2 shows a bridge/tunnel structure. The arch structure is desirably made of bent wood with a fiberglass overlay, but other conventional construction materials may be made to serve as well. The arch is desirably padded outside with 2 inches of foam, and inside with 1 inch of foam. Acoustic fabric covering is desirably perforated vinyl.

A multi-use play structure 200 has an arch piece 210 having an inside 211 and an outside 212. The arch piece has acoustic fabric covered padding or insulation 221 and 222 on both the inside and the outside respectively. Arrows 214 indicate the variety of directions in which sound is believed to be reflected by the structure. The play structure advantageously also has a floor piece 230 interengaged with the arch piece.

Figure 3:
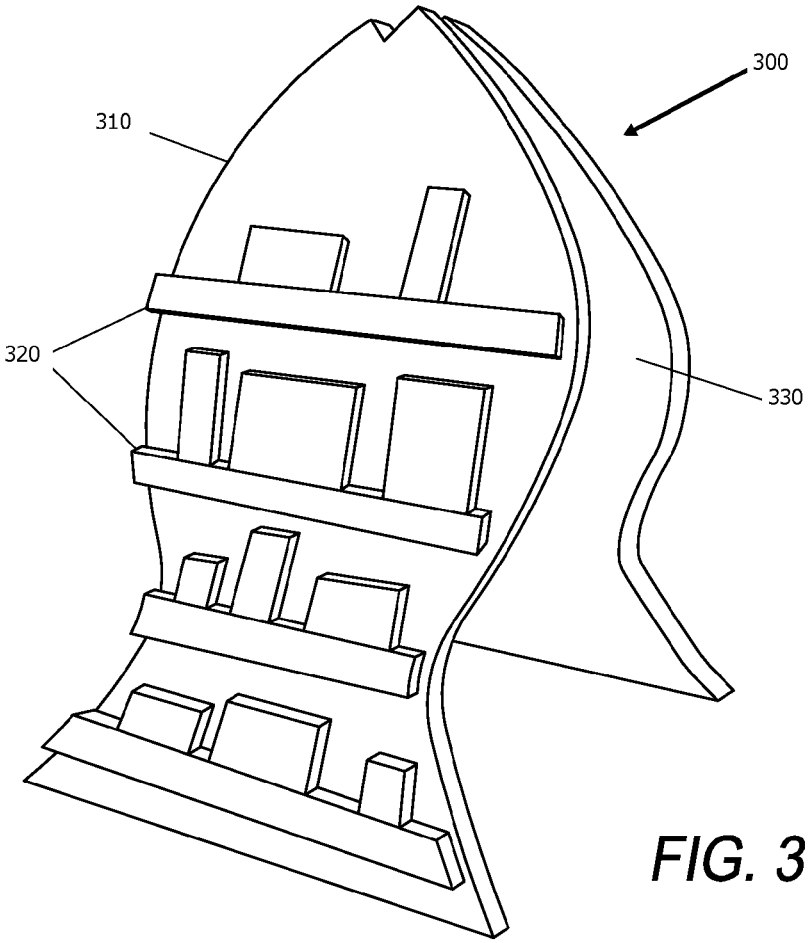
FIG. 3 is a perspective illustration of an aspect of the disclosed furniture system.

FIG. 3 shows a fish shaped book shelf. The wood structure is desirably covered at least partially in F-Sorb® acoustic material with a fabric covering. The two shelf backings are slanted to direct the unabsorbed sound at an angle toward the ceiling. The center can be used as a tunnel.

Shelf unit 300 has two shelf backing pieces 310 joined at an angle along a top portion of each piece and a plurality of shelves 320 attached to each backing piece. The backing pieces are covered at least partially by acoustic fabric 330. The two shelf backing pieces desirably have non-rectangular shapes.

Figure 4:
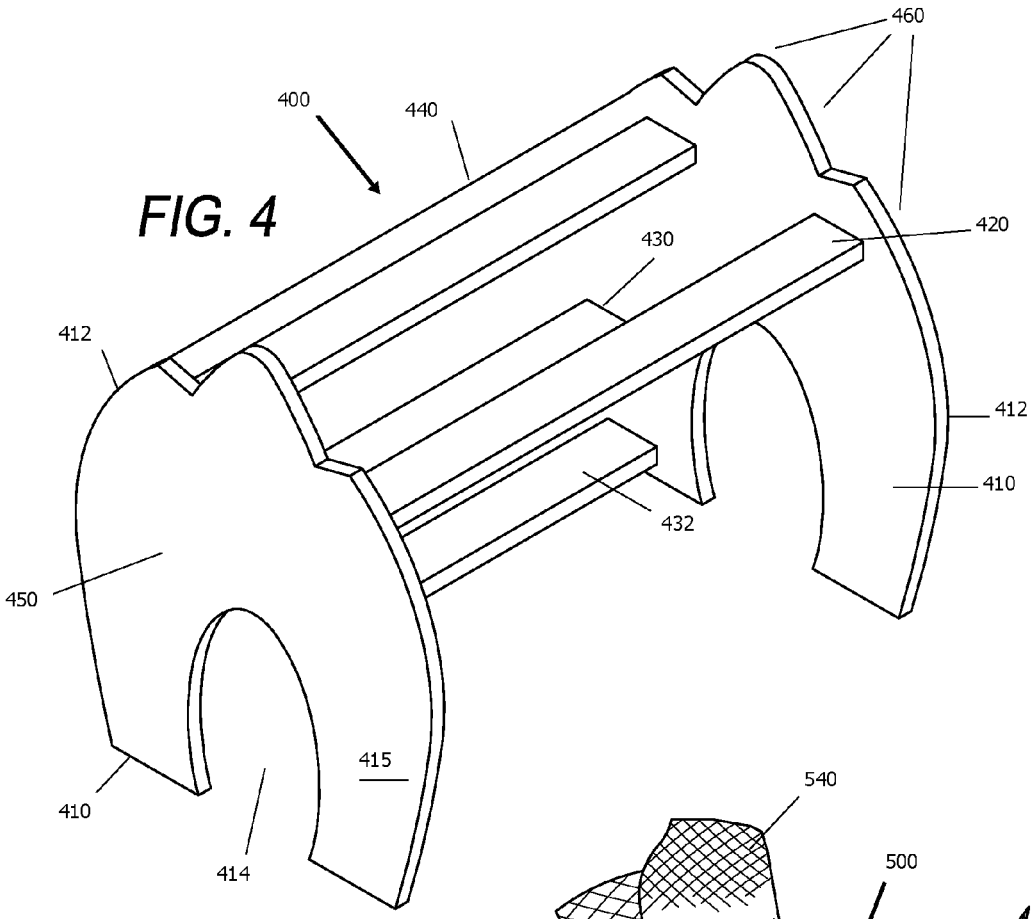
FIG. 4 is a perspective schematic cutaway illustration of an aspect of the disclosed furniture system.

FIG. 4 is a cutaway view of a tunnel with interior toy shelf. The tunnel ends are structural with at least partial acoustical covering, and the tunnel sides are non-weight-bearing acoustical material. In one embodiment one of the interior sides has 2 shelves and the other side has a very low bench for sitting or playing on. The shelves advantageously rest on support beams that hold the two structural ends together. The top is desirably left open to allow for noise inside to escape, and so caregivers can monitor activity inside. The tunnel shape is curved (it is believed) to best diffuse classroom noise that is not absorbed.

A multi-use play structure 400 has two generally vertically arranged end pieces 410. A lower portion 415 of each end piece has an opening 414. The end pieces are operatively structured with at least one generally horizontal member 420 between them. There is at least one shelf 430 situated between the two end pieces and an acoustical covering material 440 is engaged along at least a portion of the respective edges 412 of both end pieces to at least partially enclose the play structure. The multi-use play structure has acoustical covering 450 on at least a portion of both ends, and the profiles of the end pieces contain curves 460. In some embodiments one of the shelves is structured as a low bench 432; in other embodiments, the bench is present independently of the number of shelves present. The acoustical covering material that is engaged along at least a portion of the respective edges of both end pieces desirably does not cover at least a portion of the top of the play structure, which is thereby left open, as discussed above.

Figure 5:
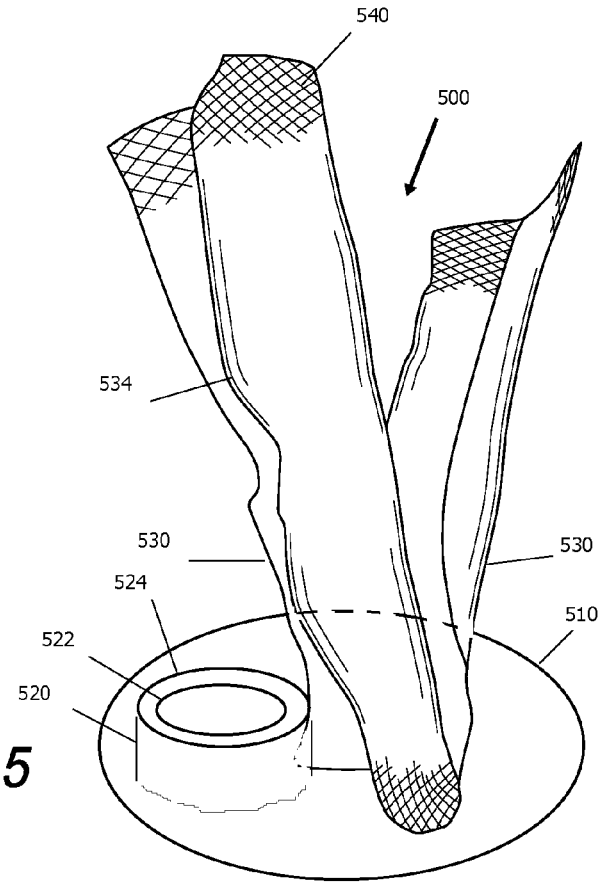
FIG. 5 is a perspective schematic illustration of an aspect of the disclosed furniture system.

FIG. 5 shows a leaning post play structure. Angled oval beams desirably reaching 5 to 6 feet high provide surfaces for children to lean while listening, resting, reading and playing. The toy box lid doubles as a seating surface, play surface, or writing surface. When open or removed, the under part of the lid is padded so it can be used as a comfortable lap table. The beams are padded with sound absorbing material, while the angle and shape are believed to help divert noise. The toy box is desirably round. The platform surface is advantageously covered with washable rubber flooring. At least one of the leaning posts is also a bendable sculpture. The bottom of the post is structural and fixed in place. The top is bendable to be repositioned by the user. The lower area is padded, the top bendable portion has a tackable surface on one beam, a mesh surface on the other.

A multi-use play structure 500 includes a container 520 and a plurality of leaning posts 530 all engaged upon a base 510. At least one post is padded with sound absorbing material 540. As part of the container a lid 524 that is padded on an underside 522 is provided. At least one of the posts is oval in cross-section. An upper portion of at least one post is a user bendable region 534.

Figure 6A:
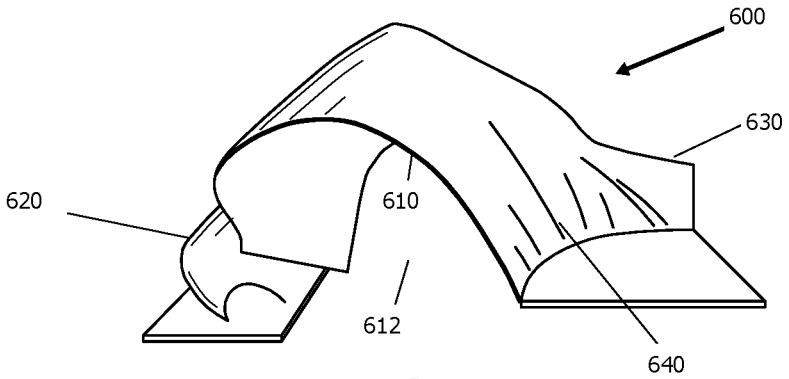
FIGS. 6A,B,C is a perspective schematic illustration of an aspect of the disclosed furniture system.
Figure 6B:
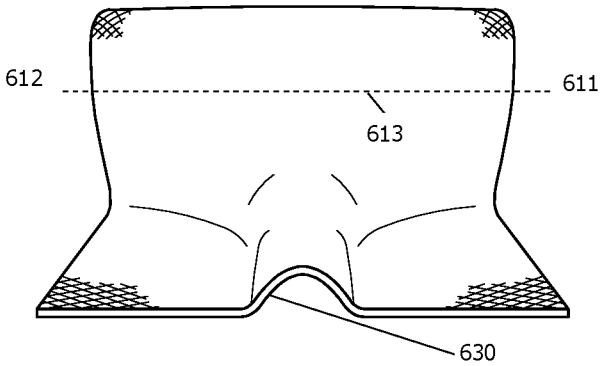
Figure 6C:
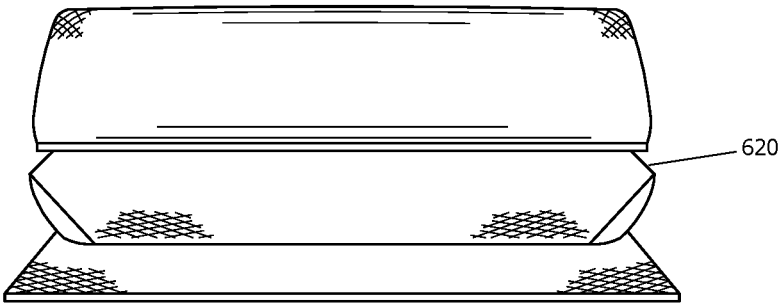

FIGS. 6A,B,C shows a combination of seat, tunnel, shelf or drawing surface with a shelf/low table area. A multi-use play structure 600 has a generally arch shaped main member 610. The arch shape is advantageously irregularly shaped and surfaced to maximize sound deflection. Beneath the arch of main member 610, children are free to move from one side to the other. One side of the main arch or tunnel is integrated with a generally flat surface 620 that can serve as a bench, or a table for children on the outside of the play structure. The other side of the main member 610 is integrated with a much smaller arch or tunnel shape 630 which can also be crawled through if made safely large enough, and or it can be used for minor climbing and or sitting by children outside the play structure. The main member has two openings 611, 612 and an axis 613 running generally between the two openings. An axis between the two openings of the smaller tunnel is desirably and generally perpendicular to the axis between the two openings in the main member, but angular variations can be made to serve as well. The play structure has at least a partial acoustical covering material 640.

Figure 7:
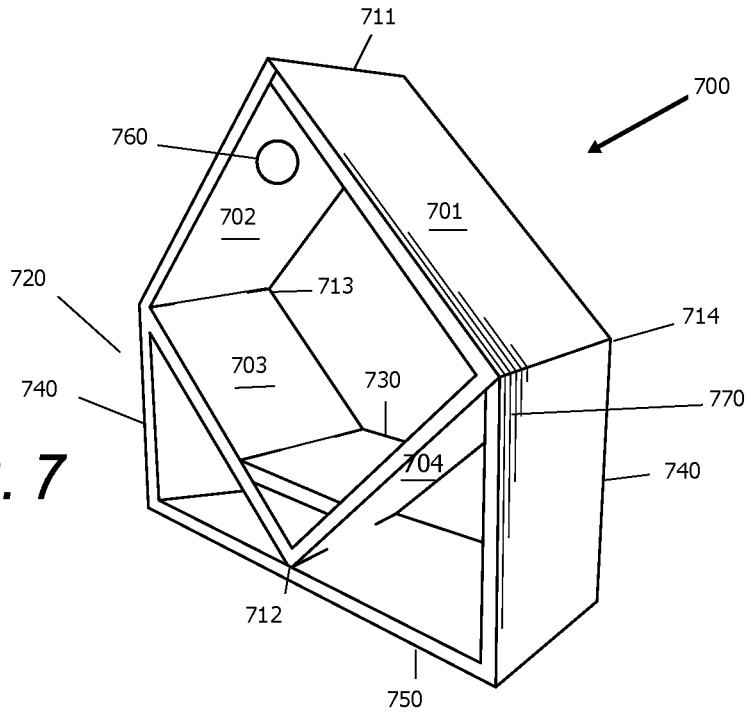
FIG. 7 is a perspective illustration of an aspect of the disclosed furniture system.

FIG. 7 is a listening center. The inside of the diamond is desirably hard surfaced, so a child sitting inside can listen to music or stories. There is an optional speaker located in the top. The outer shell is covered with acoustical polyester such as F-Sorb® to absorb classroom noise. The outer upper portion of the outer diamond shape reflects sound that is not absorbed at an upward angle. The interior reflects sound generally toward the listener. The bottom part of the diamond is a supporting area and can be used as storage or more cave like seating for smaller children. The upper diamond can seat two children.

A multi-use play structure 700 has four sides 701-704 in a generally rhomboid shape, the four sides connected respectively at an upper edge 711, a lower edge 712 and two middle edges 713, 714. The four sided structure formed thereby has a lower portion 720, the bottom of which is the lower edge 712. There is a generally horizontal shelf 730 across two sides 703, 704 in the lower portion 720 of the rhomboid and there is at least one leg 740 depending from each of the middle edges. There is desirably a base 750, the base interengaged with the lower edge 712 and with the at least one leg 740 from each of the middle edges. In one embodiment, the rhomboid shape is a diamond shape. There is an optional speaker 760 located in an upper portion of the play structure. The play structure has at least a partial outer shell 770 of acoustical material.

Figure 8A:
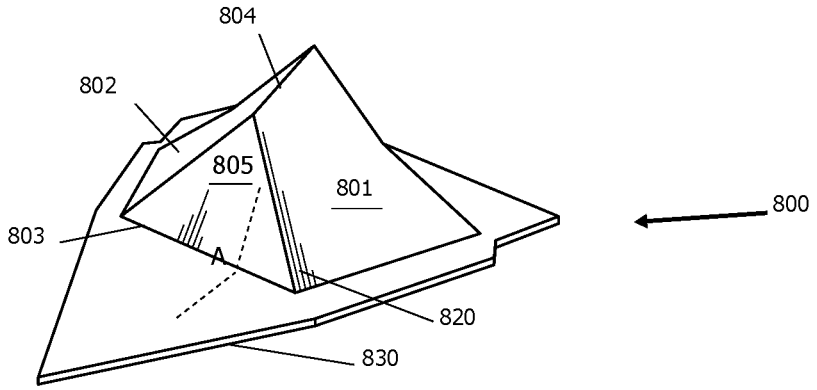
FIGS. 8A,B,C is a perspective schematic illustration of an aspect of the disclosed furniture system.
Figure 8B:
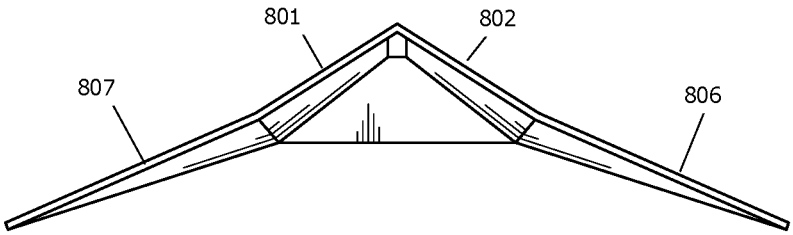
Figure 8C:
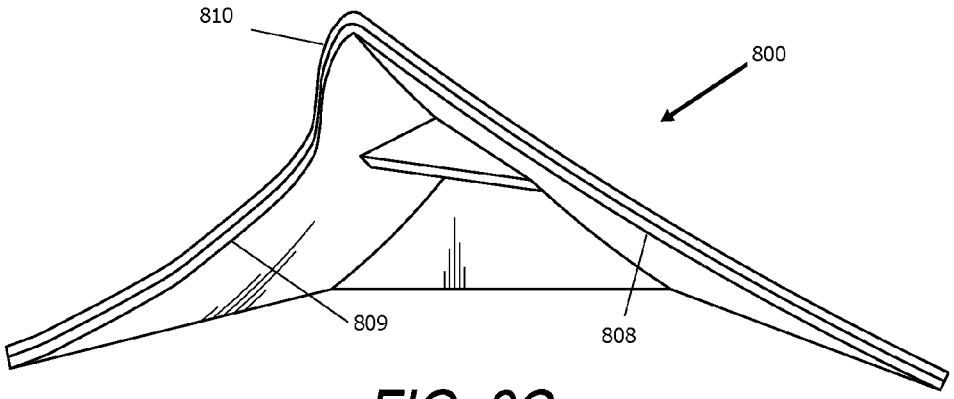

FIGS. 8A,B,C shows a stealth chair/cave structure that may advantageously be made of aluminum, wood, plastic or fiberglass, and with or without padding. A generally three-sided open multi-use play structure 800 has two side panels 801, 802 and a rear panel 803. The two side panels are connected along respective upper edges 804 thereof. Rear face 805 of the rear panel is desirably disposed at an obtuse angle A to the horizontal so that a child can lean back on it. The play structure has at least a partial outer shell of acoustical material 820. The rear panel has three edges and is desirably connected along respective upper two edges to respective rear edges of the two side panels. The play structure optionally has a base 830.

In one embodiment of the play structure, the two sides further have respective dihedral panels 806, 807 to form a different kind of flair in the opening of the structure. These dihedrals are believed to advantageously alter sound reflective and absorptive properties of the structure.

In another embodiment the play structure's two sides are non-rectangular in shape. Further, the play structure with non-rectangular sides has curved front edges 808, 809, and the play structure thereby has a front-facing beak-like projection 810 at the front of the upper edges of the two side panels, the better (it is believed) to vary kinds of play, and to disperse and absorb sound.

Figure 9A:
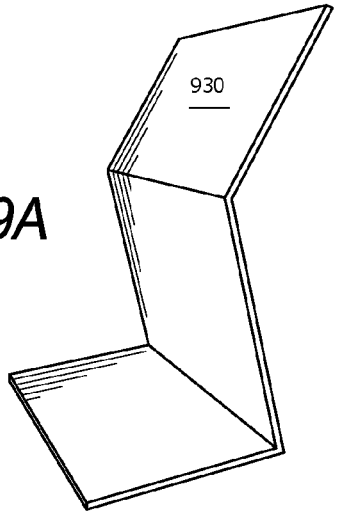
FIGS. 9A,B,C is a perspective schematic illustration of an aspect of the disclosed furniture system.
Figure 9B:
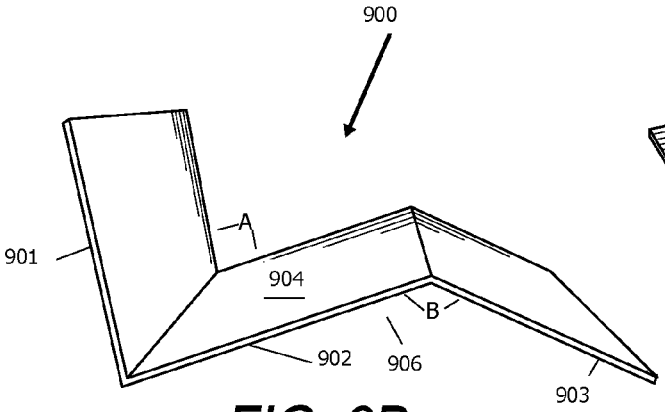
Figure 9C:
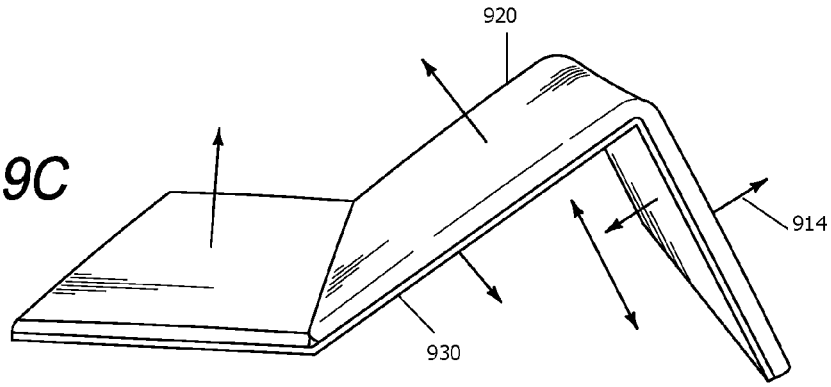

FIGS. 9A,B,C shows a convertible and multifunctional zigzag chair, that may advantageously be made of aluminum, wood, plastic or fiberglass, and with or without padding. Multi-use convertible play structure 900 has at least three panels 901, 902, 903 connected at dihedral angles A and B on either side of a middle panel 902, angle A being generally a right angle to the middle panel, angle B being an angle obtuse to the middle panel and on a face 906 of the middle panel opposite to the face 904 of the middle panel containing angle A.

The structure is convertible to many different configurations and uses, as illustrated. For example, and not by way of limitation, it can be an easel in the upright configuration, and various kinds of chairs or lounges in other configurations. All three panels are advantageously rectangles but other shapes for the end panels can also be made to serve. There is advantageously a hard surface 930 on a face of the play structure opposite to the play structure face on which a layer of padded acoustical material 920 is disposed. Arrows 914 indicate the variety of directions in which sound is believed to be reflected by the structure.

Figure 10:
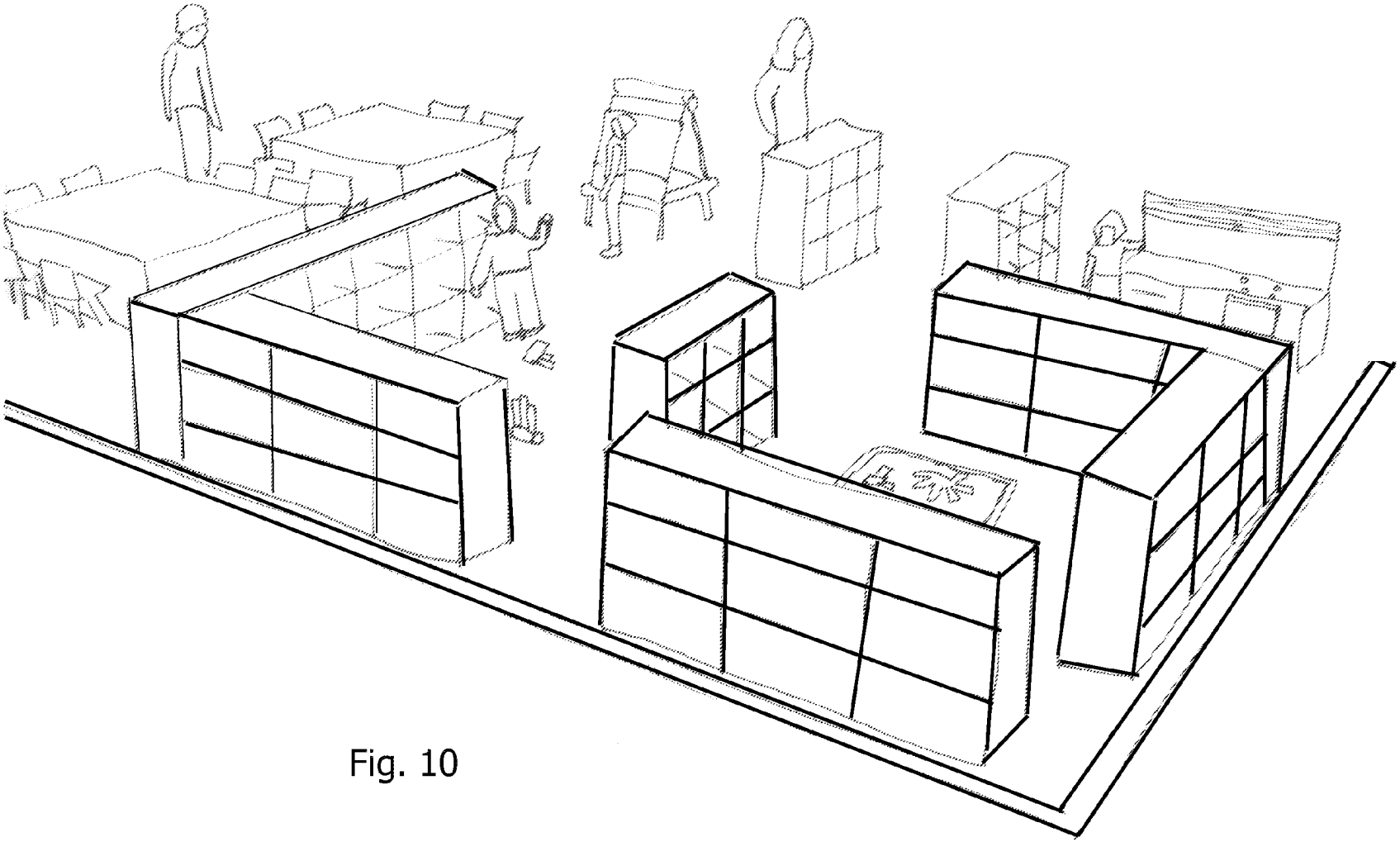
FIG. 10 is a perspective schematic illustration of prior art.

FIG. 10 illustrates a conventional day care or child learning center layout. There are numerous hard-surface shelving units, arranged as play or learning areas, along with a few tables and an easel for drawing. As discussed above, the noise levels inside these areas are actually higher than in the same room at adult hearing level (above 5 feet).

Figure 11:
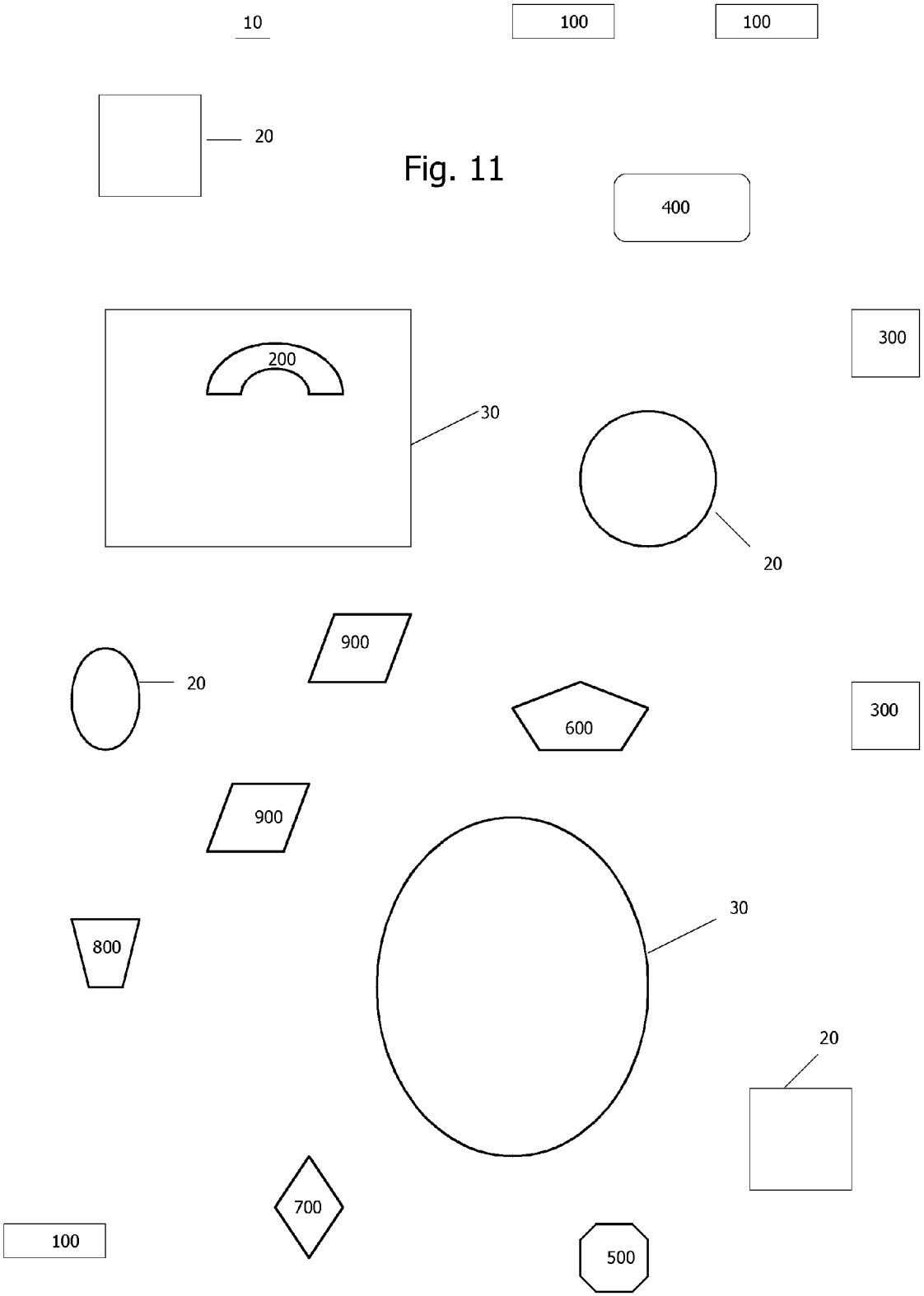
FIG. 11 is a schematic plan view of an aspect of the disclosed furniture system.

FIG. 11 is a schematic plan view of one aspect of the disclosed furniture system for adjusting sound levels in children's rooms. Furniture system 10 is arrayed in a room of generally comparable size to that shown in FIG. 10. In the room are conventional tables 20 and mats 30. However, the remainder of the furnishings in system 10 are desirably selected from among the following disclosed furniture units (described in more specific detail above, each under their own figure number): toy shelf 100, a bridge/tunnel structure 200, a sandwich board shelf unit 300, a tunnel with interior shelves 400, a toy box with leaning bendable posts 500, a bench/tunnel with combination seat, tunnel, and shelf 600, a listening center 700, a stealth chair/cave structure or stealth leaning surface/cave 800, and a convertible and multifunctional zigzag chair or multipurpose chair/easel 900.

Embodiments of the disclosed furniture system 10 have at least one of the listed furniture units above, and desirably some of each, or at least a plurality from among the listed furniture units, which plurality may advantageously be made up of multiple units of the same type, and or a mixture of the listed unit types. Again, any or all of the unit types selected for system 10 desirably have at least a partial acoustic covering and, where feasible, a full covering. Acoustic covering are desirably selected from the full range of conventional acoustic coverings, including but not limited to, conventional acoustic cloth or other material, acoustic padding and or insulation and or baffling material, and any other sound absorptive and or disruptive material now known or later developed.

Wherever used throughout the disclosure and claims, the term 'generally' has the meaning of 'approximately' or 'closely' or 'within the vicinity or range of', The term 'generally' as used herein is not intended as a vague or imprecise expansion on the term it is selected to modify, but rather as a clarification and potential stop gap directed at those who wish to otherwise practice the appended claims, but seek to avoid them by insignificant, or immaterial or small variations. All such insignificant, or immaterial or small variations are intended to be covered as part of the appended claims by use of the term 'generally'.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A furniture system for optimizing sound levels and acoustics in a learning environment, the system comprising a stealth chair/cave structure that further comprises a generally three-sided open multi-use play structure further comprising two side panels and a rear panel, the two side panels connected along respective upper edges thereof, a rear face of the rear panel disposed at an obtuse angle to the horizontal, and wherein the two side panels are non-rectangular in shape and have curved front edges, the play structure thereby having a front-facing projection at the front of the upper edges of the two side panels.

2. The furniture system of claim 1, the system further comprising multiple instances of the stealth chair/cave structure.

3. The furniture system of claim 1, each of the two side panels further comprising respective dihedral panels.

4. The furniture system of claim 1 wherein the stealth chair/cave structure further comprises:

at least a partial outer layer of acoustical material; and a structural weigh-bearing material.

5. The furniture system of claim 4 wherein the acoustical material is comprised of polyester fiber and the weight-bearing material is selected from the group of weight-bearing materials consisting of aluminum, wood and molded fiberglass and a combination of any of them.

6. The furniture system of claim 4 wherein at least part of the acoustical material consists of F-Sorb® polyester fiber paneling.

7. The furniture system of claim 4 wherein at least part of the acoustical material is covered with an acoustic path outer layer.

* * * * *